US006206660B1

(12) United States Patent
Coney et al.

(10) Patent No.: US 6,206,660 B1
(45) Date of Patent: Mar. 27, 2001

(54) APPARATUS FOR CONTROLLING GAS TEMPERATURE IN COMPRESSORS

(75) Inventors: Michael W. E. Coney; Richard A. Huxley, both of Swindon (GB)

(73) Assignee: National Power PLC, Wiltshire (GB)

( * ) Notice: Subject to any disclaimer, the term of this patent is extended or adjusted under 35 U.S.C. 154(b) by 0 days.

(21) Appl. No.: 09/284,387

(22) PCT Filed: Oct. 14, 1997

(86) PCT No.: PCT/GB97/02832

§ 371 Date: Jul. 26, 1999

§ 102(e) Date: Jul. 26, 1999

(87) PCT Pub. No.: WO98/16741

PCT Pub. Date: Apr. 23, 1998

(30) Foreign Application Priority Data

Oct. 14, 1996 (GB) ..... 9621405

(51) Int. Cl.[7] ..... F04B 39/06
(52) U.S. Cl. ..... 417/438; 60/456; 123/256
(58) Field of Search ..... 417/438; 60/456; 123/256, 299, 300

(56) References Cited

U.S. PATENT DOCUMENTS

| | | | | |
|---|---|---|---|---|
| 1,127,772 | * | 2/1915 | Junkers | 123/51 B |
| 1,683,752 | * | 9/1928 | Banner | 123/275 |
| 1,696,799 | * | 12/1928 | Held | 123/256 |
| 2,025,142 | * | 12/1935 | Zahm et al. | 230/208 |
| 2,280,845 | * | 4/1942 | Parker | 230/208 |
| 2,404,660 | * | 7/1946 | Rouleau | 230/208 |
| 2,420,098 | * | 5/1947 | Rouleau | 230/206 |
| 2,522,638 | * | 9/1950 | Ricardo et al. | 230/208 |
| 3,608,311 | | 9/1971 | Roesel, Jr. | 60/108 |
| 3,704,079 | * | 11/1972 | Berlyn | 417/438 |
| 4,924,828 | * | 5/1990 | Oppenheim | 123/299 |
| 5,058,549 | * | 10/1991 | Hashimoto et al. | 123/298 |
| 5,345,906 | * | 9/1994 | Luczak | 123/299 |
| 5,385,127 | * | 1/1995 | Karas et al. | 123/299 |

FOREIGN PATENT DOCUMENTS

| | | |
|---|---|---|
| 52528 | 1/1890 | (DE) . |
| 357858 | 2/1915 | (DE) . |
| 821993 | 11/1951 | (DE) . |
| 0043879A2 | 1/1982 | (EP) . |
| 903471 | 10/1945 | (FR) . |
| 722524 | 1/1955 | (GB) . |
| 2283543 | 5/1995 | (GB) . |
| 2287992 | 10/1995 | (GB) . |
| 2300673 | 11/1996 | (GB) . |
| 58-183880 | 10/1983 | (JP) . |

OTHER PUBLICATIONS

J. Gerstmann et al., "Isothermalization of Stirling Heat–Actuated Heat Pumps Using Liquid Pistons," 21st Intersocity Energy Conversion Engineering Conference, vol. 1, pp. 377–382.

* cited by examiner

*Primary Examiner*—Timothy S. Thorpe
*Assistant Examiner*—Timothy P Solak

(57) ABSTRACT

An apparatus is provided for controlling gas temperature during compression or expansion. The apparatus comprises a chamber for containing gas, a piston for changing the volume of gas in the chamber, a plurality of atomisers for spraying liquid into the chamber and means for delivering liquid to the atomisers. Each atomiser comprises a spray aperture and means defining a flow path for imparting rotary motion to the flow of liquid about the axis of the aperture so that on leaving the aperture the liquid divides into a conical spray. Spray apertures are positioned adjacent one another and the axes of adjacent spray apertures are oriented such that their respective sprays intersect at a position proximate at least one of the respective adjacent spray apertures.

56 Claims, 11 Drawing Sheets

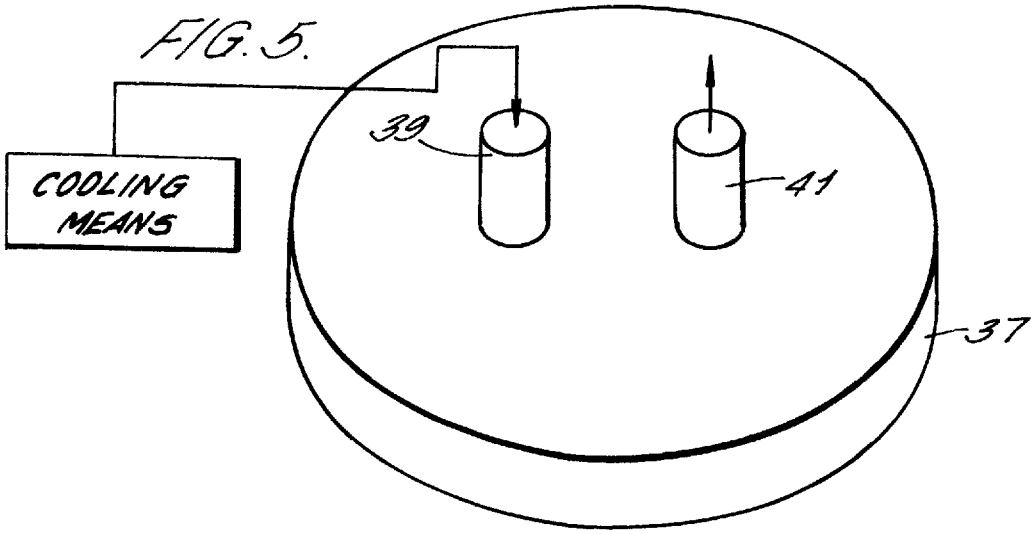
FIG. 5.
COOLING MEANS
39
41
37
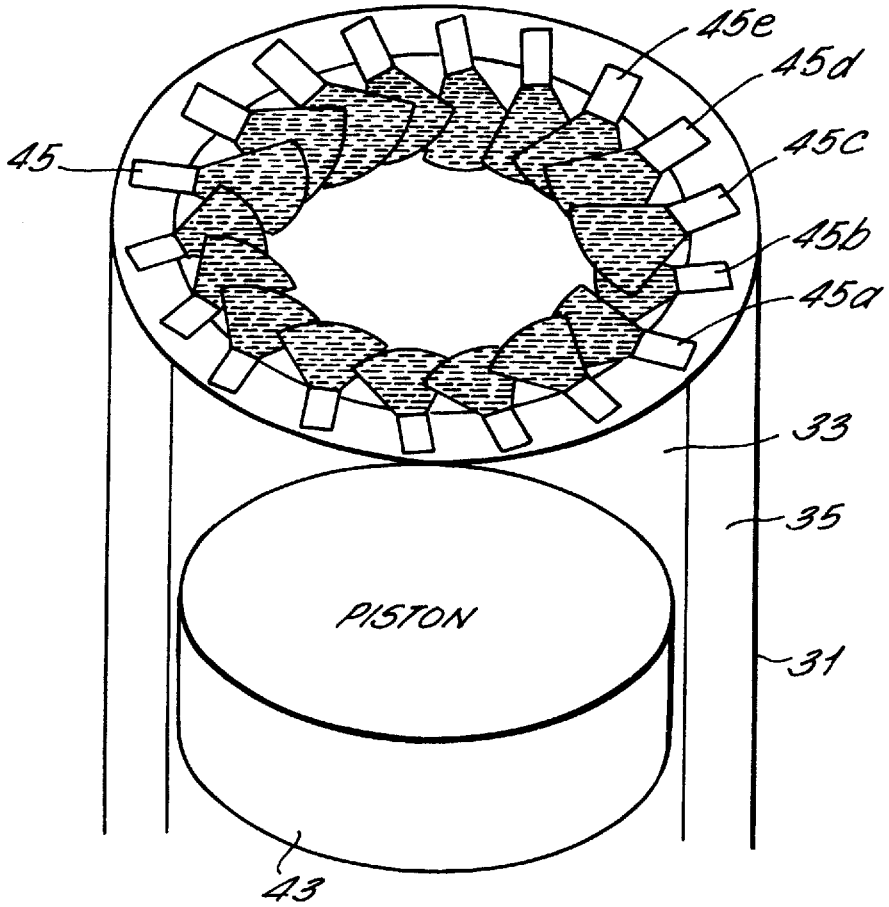
45e
45d
45c
45b
45a
45
33
35
PISTON
31
43

APPARATUS FOR CONTROLLING GAS TEMPERATURE IN COMPRESSORS

This application is the national phase under 35 U.S.C. §371 of PCT International Application No. PCT/GB97/02832 which has an International filing date of Oct. 14, 1997 which designated the United States of America.

BACKGROUND OF THE INVENTION

1. Field of the Invention

This invention relates to apparatus for controlling the temperature of gas, and in particular to apparatus which controls the gas temperature by spraying liquid into the gas.

2. Description of Related Art

The concept of spraying liquid into a compression cylinder as a means of absorbing the heat of compression is well known, and is commonly referred to in the art as wet compression. In practice, liquid is sprayed into the cylinder through a nozzle which divides the liquid into a mist of fine droplets. The droplets travel through the gas space and eventually impinge on the cylinder surfaces. While in the gas space, the droplets provide a heat sink which is in intimate contact with the gas being compressed and which has a large surface area allowing heat to be drawn efficiently from the gas and permitting a reasonable rate of compression without an appreciable rise in gas temperature.

German Patent No. DE-52528 describes a technique in which liquid is sprayed over the surfaces of the cylinder to cool the gas during compression.

German Patent No. DE-357858 describes a gas compressor which employs wet compression and uses compressed gas to drive the liquid spray. The outlet of the compression cylinder is connected to an accumulator which temporarily stores compressed gas. The accumulator also contains liquid which is fed, under the pressure in the accumulator, through a single narrow orifice into the compression cylinder via a conduit. The liquid spray is controlled solely by the pressure in the accumulator so that no active control mechanism is required. Liquid is sprayed into the compression cylinder during the whole of the induction stroke and continues to be sprayed into the cylinder during compression until the pressure in the cylinder reaches that in the accumulator.

On the other hand, U.K. Patent No. GB-722524 describes a gas compressor in which liquid is sprayed into the compression cylinder through a plurality of capillary orifices by an independent, hydraulic pump. Compressed air from the compressor is stored in an accumulator and the pressure of the accumulator is used to activate or de-activate the compressor and hydraulic pump simultaneously.

French Patent No. FR-903471 discloses a gas compressor which compresses gas in two stages in compression chambers formed either side of a single piston. The first stage compression cylinder has a concave, conical cylinder head with a single spray injector nozzle at the apex thereof. The second stage compression cylinder on the other side of the piston has an annular cross-section and receives compressed gas from the first stage compression cylinder via an accumulator. A circular channel is formed around the base of the annular cylinder, the upper side of which is formed by a perforated ring. Liquid is fed around the circular channel and is sprayed upwardly into the second stage compression cylinder through the holes in the perforated ring.

U.S. Pat. No. 2,280,845 discloses a gas compressor whose operation is based on the principle of wet compression and in which liquid is sprayed into the gas either in a separate chamber before the gas is passed to the compression chamber or otherwise directly in the compression chamber. In the former case, liquid is sprayed into a separate mixing chamber through nozzles which have an internal helical passage, which imparts rotary motion to water entering the nozzle, so that water ejected from the nozzle spreads out into a cone. This pre-mixing of water with air prior to compression allows the spray to be operated continuously rather than intermittently, i.e. only during compression, which in turn allows the flow capacity of the nozzles to be reduced. In the latter case, liquid is continuously injected directly into the compression cylinder through nozzles extending through the upper end of the cylinder casing. The nozzles each comprise a thin walled spherical head having a number of radially extending coplanar holes providing a fine spray which emerges in a plane parallel to the cylinder head and is confined to a relatively shallow zone at the top of the cylinder. This configuration is said to minimise the percentage of droplets striking the cylinder walls or piston head whilst at the same time maximising the mixing effect since air entering and leaving the cylinder is required to flow through this shallow zone.

A further example of a gas compressor using wet compression is described in Japanese Patent Publication No. 58-183880 and in one embodiment, part of the liquid which is used to compress the gas is sprayed into the compression cylinder during compression through a number of injection valves seated in the cylinder head.

It is also known to use liquid sprays as a means of transferring heat into a gas in a thermodynamic power cycle. For example, hot liquid may be sprayed into an expansion cylinder containing compressed gas, to transfer heat to the gas as it expands. A power cycle which employs this technique is described in EP-0043879.

Examples of apparatus which use liquid sprays to control gas temperature in both compression and expansion processes are described in J. Gerstmann et al, 21st Inter-Society Energy Conversion Engineering Conference, Vol. 1, pages 377–382, U.S. Publication No. 3608311 by Roesel, and the Applicant's U.K. Patent Nos. GB 2283543, GB 2287992, and GB 2300673, the contents of which are incorporated herein by reference.

There are numerous different known techniques and types of spray nozzle for generating a spray of liquid, such as multiple hole spargers as used in fire protection and shower systems, plain orifice, as used in diesel injectors, fan jet nozzles using two impinging jets of liquid, impact or impingement nozzles, pressure swirl nozzles, rotating cup and rotating disk atomisers, ultrasonic atomisers, electrostatic atomisers, and two-fluid nozzles of various kinds involving an air or gas propellant, as used in paint sprayers and aerosol propellant systems.

It is an object of the present invention to provide an improved apparatus for spraying liquid into a chamber to control the gas temperature during compression or expansion thereof.

BRIEF SUMMARY OF THE INVENTION

According to the present invention, there is provided an apparatus comprising a chamber for containing gas, a piston for changing the volume of the gas in said chamber, a plurality of atomisers, each comprising an aperture for admitting liquid therethrough into said chamber, and means for delivering a flow of liquid to the apertures, wherein each atomiser further comprises means defining a flow path for imparting rotary motion to the flow of liquid about the axis of the aperture so that on leaving the aperture the liquid divides into a spray in the cylinder.

Advantageously, this arrangement provides a spray apparatus which is capable of injecting a good spatial distribution of large quantities of fine droplets into a volume of gas, and which enables the spray to reside in the gas for a substantial length of time, thereby achieving highly efficient heat transfer. This enables the piston to be driven at higher rates than has hitherto been possible while maintaining good control over the gas temperature. Moreover, the spray apparatus consumes only a modest amount of energy as it can be driven with only modest pressures.

The apparatus may comprise a gas compressor, with the liquid sprays being used to absorb the heat of compression.

In this arrangement, the induced rotary motion of the liquid about the axis of each spray aperture causes the liquid to spread out into a thin film before leaving the aperture so that, on leaving the aperture, the liquid divides into fine droplets. The induced rotary motion also causes the liquid to emerge from all points around the circumference of the aperture, thereby providing each aperture with a relatively large flow of liquid into the cylinder. This combination of small droplet size and large liquid flow are required to achieve efficient cooling of the gas during compression.

Liquid emerging from the aperture generally forms a hollow conical spray. The provision of a plurality of apertures, each providing a hollow conical spray provides an efficient means of introducing a very large flow of fine droplets into the compression cylinder with modest energy consumption.

A further advantage of this arrangement is that each spray aperture can provide a large flow of fine droplets with modest velocities, allowing the time of flight of the droplets in the cylinder to be sufficiently long to absorb the heat of compression from the gas effectively before the droplets impinge on the surface of the cylinder or piston. This modest ejection velocity results from the fact that the energy used to create the spray includes a component of velocity which is orthogonal to the outward, axial flow of liquid through the aperture. However, the provision of a plurality of such apertures, in accordance with the present invention allows the residence time of the droplets in the gas to be increased even further. Increasing the number of injection apertures allows the liquid to be injected with a more modest differential pressure, so reducing the energy transfer to the liquid spray.

Preferably, the spray apertures are arranged so that sprays from adjacent apertures intersect one another and preferably so that adjacent sprays intersect near their respective atomiser apertures. The inventors have found that, as long as the sprays do not intersect too close to the aperture, there is surprisingly little interference between intersecting sprays of adjacent apertures, so that the spray from one atomiser can penetrate with minimal obstruction into the hollow volume enclosed by a neighbouring spray, thereby improving the distribution of droplets. This discovery can be usefully exploited to help eliminate the dry region within each conical spray from a position unexpectedly close to each aperture by arranging adjacent sprays to intersect near their respective apertures, e.g. close to the point at which the liquid film breaks into droplets.

Preferably, a plurality of spray apertures are positioned around the cylinder adjacent the peripheral corner between the wall and the end of the cylinder. This arrangement helps to maximise the path length of the droplets through the cylinder to prolong their time of flight and increase the time over which they can effectively absorb heat.

In a preferred embodiment, the apertures are arranged such that the angle of the axis of at least one, and preferably a plurality of the apertures relative to the axis of the cylinder is different from the angle of the axis of at least one other, and preferably a plurality of other apertures, relative to the axis of the cylinder. Advantageously, this arrangement enhances the evenness of the distribution of droplets along the cylinder.

In a preferred embodiment, the axis of at least one and preferably a plurality of apertures is oriented such that the flow of that part of the spray nearest the end of the cylinder is substantially aligned therewith. This arrangement ensures that at least some of the spray is directed into the endmost region of the cylinder, and that the droplets travel substantially parallel to the cylinder head to maximise their path length and survival time in the gas.

Preferably, the axis of at least one and preferably a plurality of apertures is oriented such that flow of part of the spray nearest the wall of the cylinder is substantially aligned therewith, or at least some of the apertures are oriented so that the liquid spray just skims the cylinder wall. This arrangement not only helps to ensure that there are a sufficient number of droplets in the region adjacent to the cylinder wall but also ensures that these droplets, which are travelling substantially parallel with the cylinder wall do not impinge thereon and thereby have a sufficient residence time in this region to provide effective heat absorption from the gas.

Preferably, a plurality of apertures are circumferentially spaced around the axis of the cylinder and the angle between the axis of at least one, and preferably a plurality of the circumferentially spaced apertures and the cylinder axis is different from the angle between the axis of a respective adjacent, circumferentially spaced aperture and the cylinder axis. Orienting axes of adjacent circumferentially spaced apertures at different angles relative to the cylinder axis removes the point of interference between adjacent conical sprays from the vicinity of the apertures, thereby reducing the probability of droplet agglomeration and consequential reduction in heat transfer efficiency.

Preferably, the axes of the circumferentially spaced apertures are directed through a range of angles relative to the cylinder axis with the difference in angle between axes of adjacent apertures being greater than the difference between the angles of alternate apertures. Advantageously, this configuration provides an arrangement of circumferentially spaced apertures whose axes are oriented relative to the cylinder axis over a range of angles with minimum interference between sprays from adjacent apertures. Preferably, this configuration is applied to most of the apertures in the circumferentially spaced arrangement.

In a preferred embodiment, a plurality of apertures are positioned around the wall of the cylinder and adjacent to the end thereof or positioned in the circumferential corner of the cylinder between the wall and the end. Advantageously, this arrangement allows a very large number of apertures to be accommodated with a large variety of different orientations to provide a good distribution of droplets throughout the cylinder and allows the spray to be maintained in the cylinder as the piston approaches the end of the compression stroke.

In a preferred embodiment, the axis of at least one, and preferably a plurality of apertures, is directed so as not to intercept the cylinder axis. Surprisingly, the inventors have found that offsetting the axes of the spray apertures to one or other side of the cylinder axis improves the evenness of the distribution of the droplets within the cylinder. In one embodiment, a plurality of apertures are circumferentially spaced around the axis of the cylinder with the axes of the circumferentially spaced apertures being offset to the same side of the cylinder axis as viewed from a respective aperture. The inventors have further discovered that offsetting circumferentially spaced apertures to the same side of the cylinder axis further improves the distribution of droplets in the cylinder.

Preferably, the axes of adjacent circumferentially spaced apertures are offset to the same side of the cylinder axis as viewed from a respective aperture by different angles. The inventors have found that offsetting axes of adjacent apertures by different amounts can improve the homogeneity of the droplets in the cylinder even further.

In another embodiment, at least two and preferably a plurality of apertures are spaced apart in a direction parallel to the axis of the cylinder. The apertures may be circumferentially spaced around the cylinder in a plurality of rows separated in a direction parallel to the cylinder axis and preferably apertures of at least one row are circumferentially positioned between adjacent apertures of an adjacent row. Advantageously, this arrangement reduces the length of cylinder wall required to accommodate a plurality of rows of apertures and increases the number of apertures of a given size that can be accommodated within the cylinder, which in turn, increases the flow rate of the droplets into the cylinder.

The cylinder wall may comprise a plurality of discrete parts, at least one of which contains a plurality of atomisers. In one embodiment, the cylinder comprises a ring, the inner face of which defines part of the cylinder wall and which contains a plurality of circumferentially spaced spray apertures. The ring may also include a channel which is arranged to deliver liquid to at least two or more of the spray apertures. In another embodiment, the apertures may be contained in one or more plugs, wherein each plug preferably contains a plurality of atomisers. Preferably, the spray apertures in the plug are arranged in a compact array and, preferably, the axes of at least two of the apertures within the array are angled differently.

In a preferred embodiment, the apparatus further comprises control means arranged to control the flow rate of liquid through at least one and preferably a plurality of spray apertures as a pulsed flow during compression. Preferably, the control means is arranged to control the flow rate of the liquid through each aperture so that the flow rate is substantially higher during the latter part of compression than during the earlier part of compression. Advantageously, introducing a higher flow rate into the compression cylinder during the latter part of compression as compared to the earlier part of compression has been found to provide adequate cooling of the gas during compression while offering the benefit of a significant saving in the total amount of liquid required. Furthermore, it has been found that the swirl atomiser has a particularly fast response time and is well suited to pulsed flow. It has also been found that the shorter the pulse, the less interference there is between intersecting conical sprays so providing better droplet distribution and more effective heat absorption. This means that the spray is more effective as a temperature transfer medium when generated over a shorter pulse duration which, advantageously allows the compression rate to be increased without necessarily having to increase the mass flow of liquid into the cylinder to maintain the same temperature.

In preferred embodiments the maximum number of nozzles with smaller apertures will be fitted into the minimum space to achieve the desired flowrate for a specified pressure drop. Smaller apertures will produce smaller droplets that are more efficient in their heat transfer capability. The greater number of sprays will also improve the distribution of droplets and reduce the number of dry zones.

In preferred embodiments, at least ten atomisers/spray apertures are provided in a single cylinder, and may all be arranged in a circumferential row. However, a smaller number may be used depending on the size of the cylinder. Preferably, each row will contain ten or more atomisers, for example between ten and twenty-five or more and each cylinder may have more than one row, e.g. between two and five or more.

BRIEF DESCRIPTION OF THE DRAWINGS

Examples of embodiments of the invention will now be described with reference to the drawings, in which:

FIG. 5 shows a schematic, perspective view of one embodiment of the present invention;

DETAILED DESCRIPTION OF THE INVENTION

Figure 1:
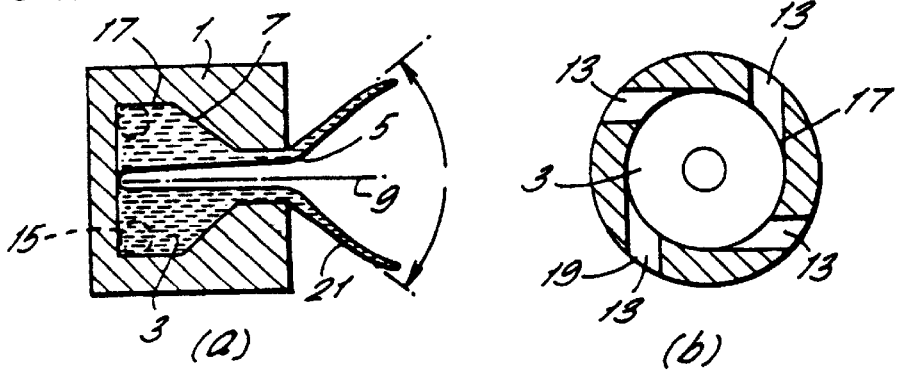
FIG. 1. PRIOR ART
FIGS. 1(*a*) and (*b*) show cross-sectional views of one embodiment of a pressure swirl atomiser according to the prior art.

FIGS. 1 to 4 illustrate a number of different types of known pressure swirl atomisers which may be used in various embodiments of the present invention. Each of the atomisers comprises a casing or housing 1 enclosing a chamber 3 having a spray outlet aperture 5. The forward part 7 of the chamber wall is generally symmetrical about the axis 9 of the spray aperture 5 and includes a generally conical section which tapers towards the spray aperture 5. Each of the atomisers further comprises a plurality of liquid inlet ports 13 in the rear 15 of the chamber 3 which direct liquid into the chamber so as to cause the flow of liquid to rotate within the chamber about its axis 9 and the main difference between the atomisers shown in FIGS. 1 to 4 is how this is achieved.

Figure 2:
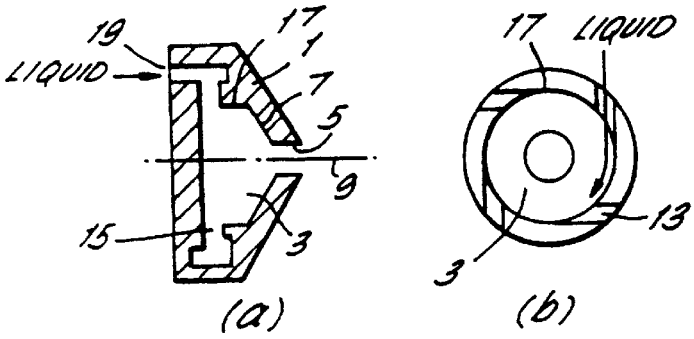
FIG. 2. PRIOR ART
FIGS. 2(*a*) and (*b*) show cross-sectional views of another form of pressure swirl atomiser according to the prior art.

Referring to FIGS. 1 and 2, a number of inlet ports 13 are positioned around and tangentially with the circumference 17 of the cylindrical chamber 3. In the atomiser shown in FIG. 1, the casing inlets 19 are substantially normal to the chamber axis 9, whereas in the atomiser shown in FIG. 2, the casing inlets 19 are substantially parallel to the chamber axis 9. As a flow of liquid enters the chamber 3 through the tangential inlet ports 13, the flow is bent into a circular path by the chamber wall and is forced to rotate about the chamber axis 9. As the liquid flows parallel to the chamber axis 9, towards the spray aperture 5, the liquid is forced into an increasingly tighter circle by the tapered, forward part 7 of the chamber, increasing the angular velocity of the liquid so that the liquid flows through the spray aperture 5 as a thin cylindrical sheet. On leaving the aperture, the thin cylindrical sheet of liquid spreads out into a cone 21, as shown by way of example in FIG. 1, and divides into a spray of fine droplets.

Figure 3:
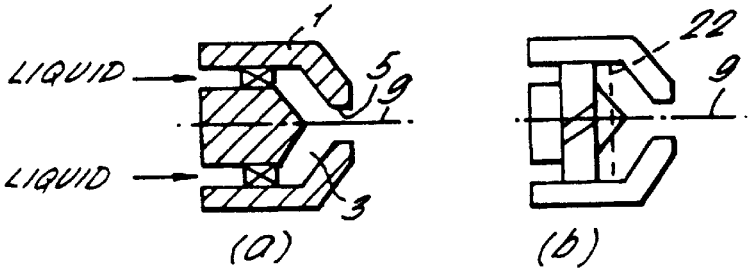
FIG. 3. PRIOR ART
FIGS. 3(*a*) and (*b*) show cross-sectional views of another form of pressure swirl atomiser according to the prior art.

The atomiser shown in FIG. 3 has a number of inlet ports defined by a series of helical slots positioned circumferentially around the rear of the chamber 3. The helical slots impart rotary motion to the liquid as it flows through the rear inlet ports 15 at the rear of the atomiser into the chamber 3. As liquid propagates towards the spray outlet it is deflected into increasingly tighter circles by the conical forward portion, is transformed into a thin conical sheet and emerges from the spray aperture 5 as a hollow conical spray, similar to that shown in FIG. 1.

Figure 4:
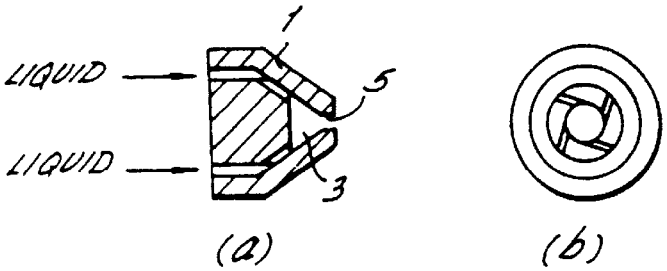
FIG. 4. PRIOR ART
FIGS. 4(*a*) and (*b*) show cross-sectional views of another known pressure swirl atomiser.

The atomiser shown in FIG. 4 has a number of liquid inlet ports 13 positioned circumferentially around the rear of the chamber and which are defined by a number of helical channels which are aligned with the conical forward part of the chamber 3. This atomiser operates in a similar way to that shown in FIG. 3.

FIG. 5 shows a schematic diagram of a gas compressor in accordance with one embodiment of the present invention. Referring to FIG. 5, the gas compressor 31 comprises a compression cylinder 33 defined by a cylinder wall 35 and a cylinder head 37. A gas inlet port 39 and a gas outlet port 41 are provided to allow gas to be drawn into and out of the cylinder 33 and in this embodiment are located in the cylinder head 37, although in other embodiments they may be located at other positions. A compression piston 43 is provided to compress the gas in the compression cylinder 33 and may be driven by any suitable means. The piston may be coupled to a rotary device, such as a crankshaft or other device so that movement of the piston is controlled through a mechanical coupling or the piston 43 may be a free-piston driven by any suitable means such as the energy stored in a fluid.

The gas compressor 31 further comprises a plurality of pressure swirl atomisers 45 spaced circumferentially around and adjacent the top of the cylinder 33. Each atomiser 45 generates a conical spray by causing the liquid to rotate within the atomiser as for example described above with reference to FIGS. 1 to 4. Each atomiser 45 is positioned so as to direct its spray into the cylinder, and are positioned sufficiently close so that the sprays of adjacent atomisers 45 intercept. Advantageously, this arrangement can collectively provide a well distributed, dense mist of fine droplets throughout the volume of the compression cylinder and provides an effective and efficient heat sink by which to absorb heat from the gas during compression. In the preferred arrangement, each atomiser is arranged to generate droplets of sufficiently small mean diameter so as to provide a very large surface area of liquid per unit volume, given the restrictions on atomiser differential pressure and the maximum desirable ejection velocity. However, droplet size depends on the flow capacity of the atomisers with droplet size decreasing with decreasing flow capacity. The arrangement compensates for this dependency of droplet size on flow capacity of the atomiser by providing a large number of atomisers which is also conducive to generating a well distributed spray of droplets throughout the cylinder. Furthermore, by arranging the atomisers so that the conical sprays from adjacent atomisers intersect, preferably near their respective apertures, droplets from one atomiser penetrate into the volume enclosed by the hollow cone of an adjacent spray, thereby significantly enhancing the distribution of droplets in that region. Another advantage of this arrangement is that the pressure drop across each atomiser required to generate a conical spray is relatively low and therefore consumes only a small amount of energy. This allows many such atomisers to be used with only modest energy consumption.

As shown in FIG. 5, the atomisers are arranged around the periphery of the cylinder and adjacent the cylinder head, with the sprays being directed generally across the cylinder. This arrangement ensures that the path length of the droplets is as long as possible at all positions of the piston. A relatively long path length and modest exit velocity of the droplets from the spray aperture both help to maximise the droplet residence time in the gas so that the droplets can absorb more heat. Once the droplets impact onto one of the solid surfaces within the cylinder, their ability to absorb heat from the gas is significantly reduced.

The included angle of the conical spray from each spray aperture is typically between about 70° and 80°, depending on the flow rate and ambient pressure. Advantageously, positioning the spray apertures adjacent the cylinder head prevents the apertures from being blocked by the piston until the piston is virtually at top dead centre. As the compression of gas will generally be completed before the piston reaches the top of its stroke, at least the upper edge of the spray, which for at least some atomisers is aligned with the piston head can pass into the cylinder without obstruction until compression is complete.

Another important characteristic of the arrangement shown in FIG. 5 is that a well distributed spray of fine droplets throughout the cylinder is achieved with a plurality of atomisers positioned around the periphery of the cylinder which leaves at least the central part of the cylinder head available for the provision of gas inlet and outlet ports and valves. The cylinder walls and cylinder head may be formed integrally or as separate parts and the atomisers may either be mounted in the cylinder head or the cylinder wall, or both. The spray axes of the atomisers may be oriented in various ways so as to improve the distribution of droplets within the cylinder, as will be explained in more detail below.

To maximise the effectiveness of the droplets as an agent or medium for absorbing heat from gas, it is important to ensure that the liquid droplets are distributed homogenously throughout the gas volume. Variations in the concentration of droplets have a detrimental impact on performance. A low concentration of droplets reduces the heat absorption capacity within that region resulting in poor local cooling of the gas. On the other hand, while excessively high concentrations of droplets may give good local cooling, they will also lead to droplet agglomeration so that the liquid becomes less effective over the remaining part of its travel, possibly to the point whereby the liquid falls out of the gas space before it reaches the cylinder wall. The atomisers used in the present arrangement each generate a hollow conical spray which, by definition is inhomogeneous, and which does not readily lend itself to providing a homogenous spray within the enclosed volume of a cylinder. In the preferred embodiment, the atomisers are arranged sufficiently close so that the spray from one atomiser intercepts and interferes with the spray from an adjacent atomiser in order to provide droplets within the otherwise droplet-free hollow conical region. However, this arrangement results in regions of high concentration where sprays from adjacent atomisers intercept, and which can be detrimental to the performance of the spray for the reasons mentioned above. The inventors have found that the evenness of the distribution of droplets throughout the cylinder can be significantly improved by varying the orientation of the spray axes of the atomisers.

Figure 6:
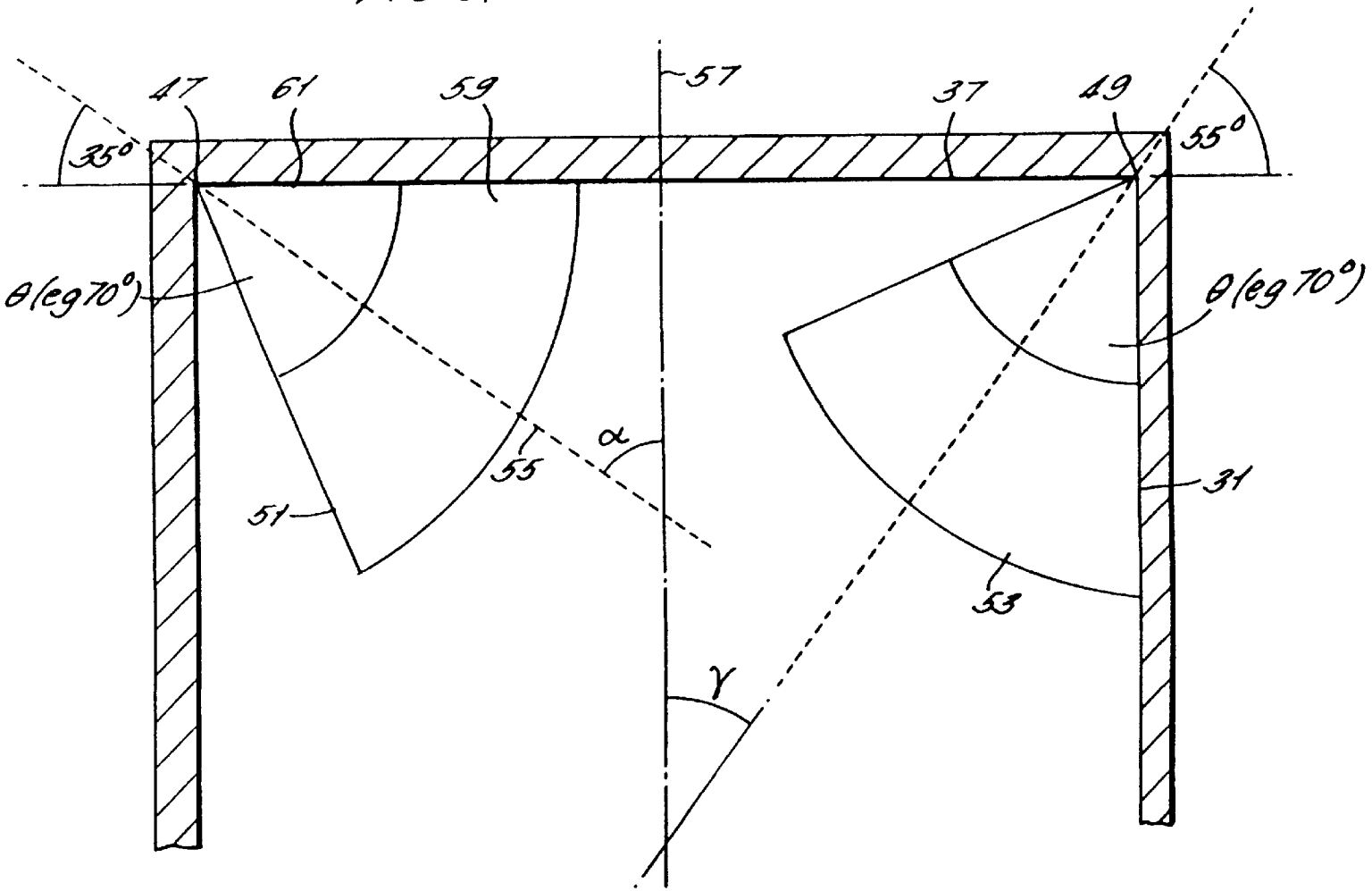
FIG. 6 shows a schematic diagram of a compression cylinder and two possible orientations of the axis of a conical spray relative to the cylinder axis.

As mentioned above, the atomisers should preferably be arranged to provide droplets which are directed across the top of the cylinder adjacent the cylinder head. Droplets so directed will neither impinge on the piston nor on the surface of the cylinder head, but will traverse a relatively long path across the cylinder and remain within the rapidly diminishing gas volume to provide effective cooling of the gas substantially to the end of the compression stroke. The conical spray generated by pressure swirl atomisers have a typical cone angle of about 70°. Therefore, at the same time as spray liquid is directed across the top of the cylinder, droplets are also directed down into the cylinder through a spread angle of about 70° and in one embodiment, it is possible to rely upon the droplets directed into the bulk of the cylinder over this spread angle to provide a reasonable distribution of droplets throughout the cylinder, including the volume of gas adjacent the cylinder walls. However, in a preferred embodiment, the axes of at least some of the spray apertures are oriented such that some of the droplets are directed parallel and adjacent to the cylinder walls, and preferably so that the extreme edge of the conical spray is parallel and adjacent the cylinder walls. In this way, the volume of gas adjacent the cylinder walls is filled with droplets from the spray aperture which is nearest that volume so that the volume is filled much faster than could be achieved by droplets from another aperture, for example on the other side of the cylinder. This ensures that the volume adjacent the walls of the cylinder are filled with droplets in the shortest possible time which is particularly important for achieving effective cooling at the high piston velocities which accompany high rates of compression. Furthermore, in this arrangement, droplets close to the cylinder wall are travelling parallel to the surface of the cylinder wall which maximises their survival time in the gas. FIG. 6 shows schematically two orientations of the atomisers with respect to the cylindrical axis which achieves the desired effect.

Referring to FIG. 6, spray apertures (not shown) are positioned in each corner 47, 49 where the cylinder wall 31 meets the cylinder head 37. In this example, the spread angle $\theta$ of both conical sprays 51, 53 is 70°. The axis 55 of the spray aperture of the atomiser situated in the left-hand corner 47 is oriented at an angle $\alpha=90-\theta/2=55°$ relative to the cylindrical axis 57 so that the upper edge 59 of the conical spray is parallel to the surface 61 of the cylinder head 37.

The axis of the spray aperture located in the upper right-hand corner 49 of the cylinder is oriented at an angle $\gamma=\theta/2=35°$ relative to the cylinder axis 57 so that the edge of the conical spray closest to the cylinder wall 31 is directed along the cylinder wall.

The specific angles mentioned above are quoted simply for the purposes of illustration only. As previously mentioned, the actual cone angle is dependent on factors such as flow rate, the geometry of the atomiser and ambient pressure, and the precise orientation of the atomiser to provide alignment with the edge of the conical spray either with the cylinder head or the cylinder wall will depend on the cone angle from a particular atomiser and therefore may be different to the angles mentioned above in relation to FIG. 6. In practice, the cone angle may vary with distance from the aperture. In particular, the cone angle may be higher close to the spray aperture with a tendency to decrease further away, as shown in FIG. 1. The departure from a perfect conical shape is believed to be caused by air motion induced by the droplets supplemented by surface tension effects very close to the spray aperture. In this case, the angle of orientation of the axes of the spray apertures relative to the cylindrical axis may be calculated on the basis of the maximum cone angle.

Although in the illustrative embodiment shown in FIG. 6, the surface of the cylinder head 37 within the cylinder is flat and perpendicular to the cylinder walls 31, in other embodiments, at least a portion of the cylinder head need not be flat and the angle between the cylinder head and the cylinder walls may be either less than or more than 90°. In this case, the axes of the spray apertures would be oriented at appropriate angles relative to the cylindrical axis to ensure that part of the spray is directed generally along the surface of the cylinder head and cylinder walls.

In one embodiment, the axes of the spray apertures may be oriented so that the upper edge of the conical spray of every other, i.e. alternate spray aperture is directed along the cylinder head and the edge of the conical spray from the spray apertures in between is directed along the cylinder wall. In a preferred embodiment, the axes of some of the spray aperture is relative to the cylinder axis are also oriented at at least one further angle between the two extremes. For example, the axes of some of the spray apertures may be oriented at a plurality of intermediate angles, for example at three intermediate angles such as 40°, 45° and 50° as well as the two extreme angles of 35° and 55° in the arrangement shown in FIG. 6. Preferably, the difference in the angle of orientation, relative to the cylinder axis, of adjacent spray apertures is as large as possible. This arrangement serves to increase the distance between the point of interference of adjacent conical sprays from their respective spray apertures. Although it is important that the spray cones interfere with one another so that droplets are able to reach the inside of the otherwise hollow cones, the liquid spray is most dense in the region nearest the aperture. Thus, by ensuring that the first points of interference between the conical sprays is removed from this region, the probability of droplet agglomeration is significantly reduced and the spray distribution improved.

However, in an arrangement where the axis of the spray apertures are oriented relative to the cylinder axis over a plurality of intermediate angles, it is not a simple matter to arrange their orientations so that the difference in orientation of axes of adjacent apertures is maximised to achieve this improved distribution. This is because if the angular separation between two adjacent apertures is maximised, i.e. the axes are widely divergent, then the angular separation between the axes of the next two apertures is likely to be minimal. However, this problem can be overcome by arranging the spray apertures so that the angular separation between alternate apertures is less than the angular separation between adjacent apertures. For example, a suitable sequence of angles relative to the cylinder axis for a series of circumferentially spaced apertures in the above example would be "35, 50, 40, 55, 45, . . . etc." which is then repeated. For example, this sequence could be applied to the atomisers 45*a* to 45*e*, of the embodiments shown in FIG. 5. In another embodiment, there may be more than one row of apertures around the circumference of the cylinder displaced parallel to the cylinder axis. In this case, a similar sequence could be extended over atomisers in two or more adjacent rows on the basis of closest proximity, e.g. in the circumferentially or axially spaced direction. For example, the next angle in the sequence could be applied to the nearest atomiser in the adjacent row (or column). Thus, in the sequence above, an angle of 35° would be applied to a given atomiser, an angle of 50° would be applied to the nearest atomiser to it, regardless of which row it was in, then an angle of 40° would be applied to the next nearest atomiser and so on.

Figure 7:
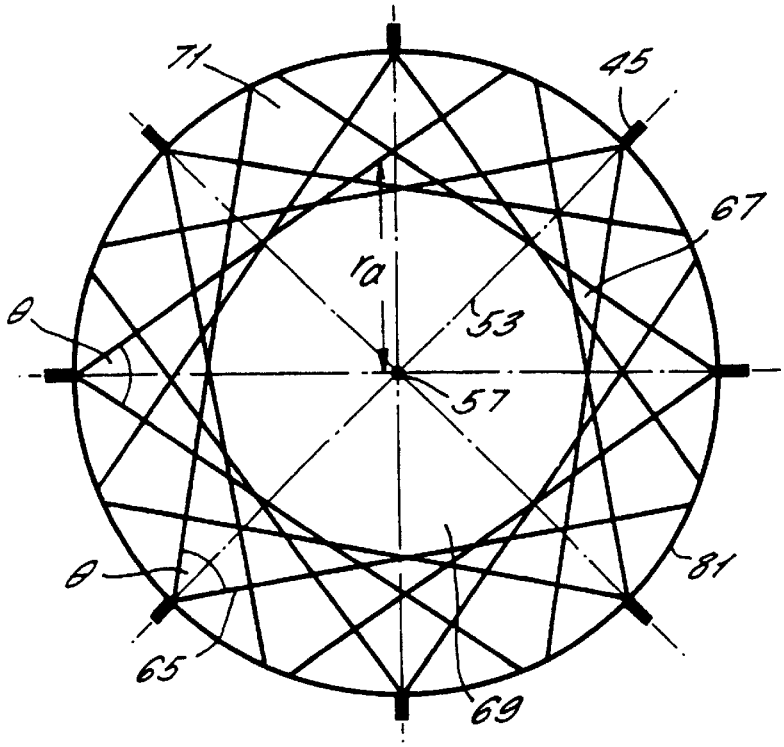
FIG. 7 shows a schematic view along the axis of a compression cylinder according to one embodiment of the present invention.

FIG. 7 shows an axial view through a cylinder 31 having a plurality of atomisers 45 circumferentially spaced around the periphery thereof. In this embodiment, the axes of the atomiser spray apertures 53 are all directed so as to intercept the cylinder axis 57. The extreme edges of the conical spray from each atomiser 45 are shown by the solid straight lines 65 and are separated by a cone angle θ which in this embodiment is about 70°, although in other embodiments the cone angle may be different. It can be appreciated from FIG. 7 that this configuration provides a relatively high concentration of droplets in an annular region 67 at a radius of $r_a=(\tan\theta/2)R=0.7R$, where R is the radius of the cylinder. The concentration within the central zone of the cylinder with a radius $r \geqq r_a$ is relatively low and the region 71 outside the annular zone 67 will include zones which are also poorly supplied with liquid.

To improve the evenness of the distribution of liquid droplets transverse to the cylinder axis, the axes of the atomiser spray apertures are offset so as not to intercept the cylinder axis. This may apply to only some or all of the atomisers. In a preferred embodiment, the spray apertures of adjacent atomisers are offset to the same side of the cylinder axis and as viewed from a respective aperture. Examples of the embodiments incorporating such an angular configuration are shown in FIGS. 8 to 10.

Figure 8:
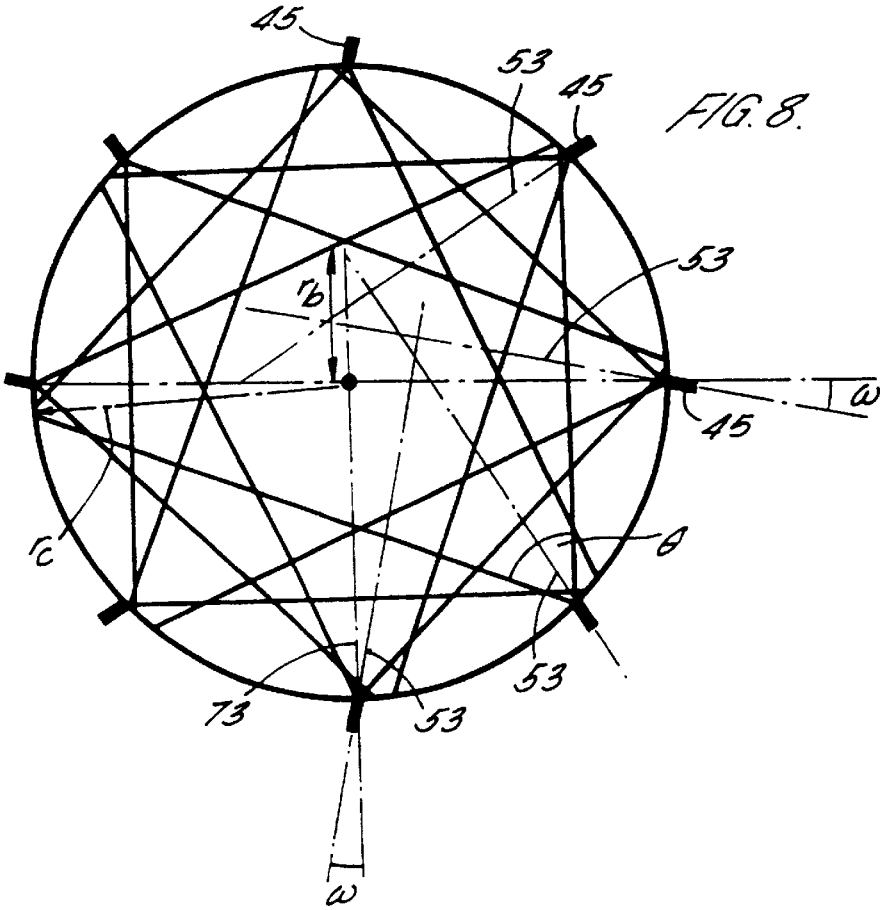
FIG. 8 shows a schematic view along the axis of a compression cylinder in accordance with another embodiment of the present invention.

Referring to FIG. 8, the axes 53 of all of the spray apertures of the atomisers 45 are offset at an angle $\omega=10°$ relative to the respective cylinder radii 73 from each aperture. This arrangement provides a more homogenous distribution of droplets with two weaker concentration zones, one being at a radius $r_b=R\tan(\theta/2-\omega)=R\tan(35-10)=0.47R$ and the other being at $r_c=R\tan(\theta/2+\omega)=R\tan(35+10)=1.0R$. Thus, is advantageously, the offset divides the liquid between two concentration zones.

Figure 9:
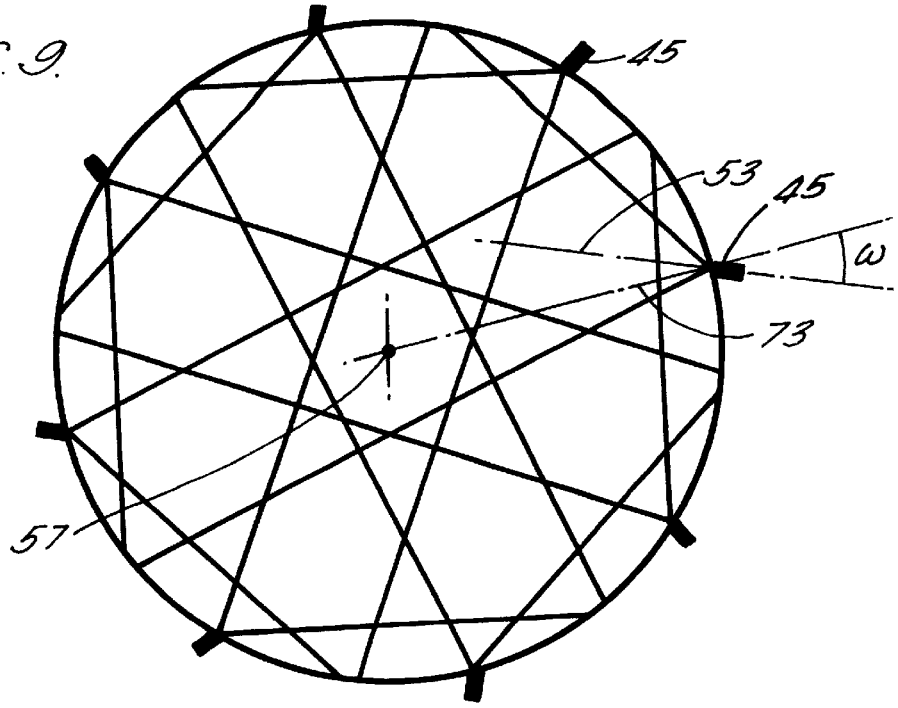
FIG. 9 shows a schematic view along the axis of a compression cylinder in accordance with another embodiment of the present invention.
Figure 10:
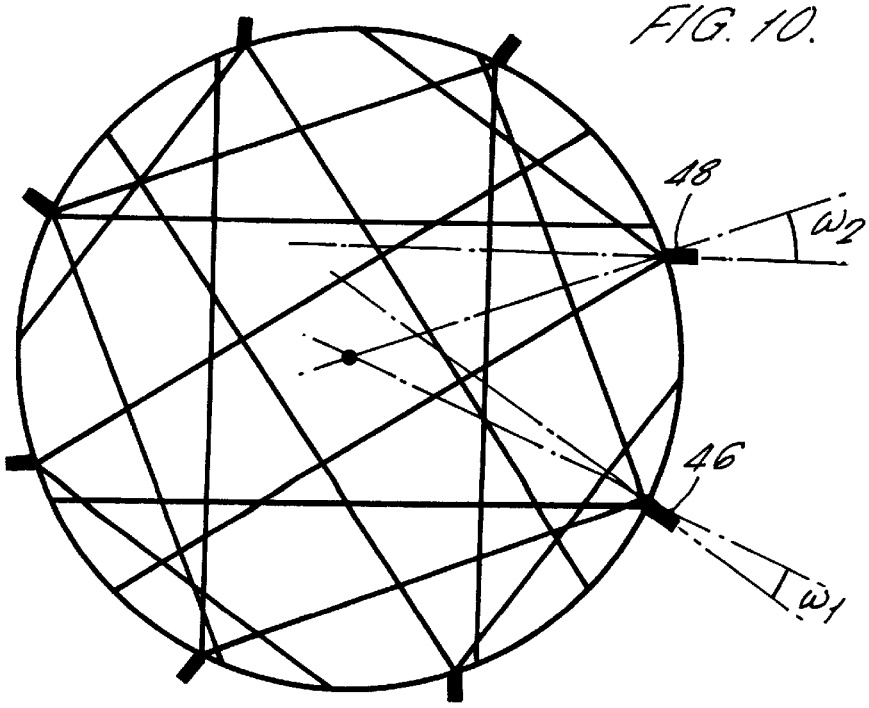
FIG. 10 shows a schematic view along the axis of a cylinder in accordance with another embodiment of the present invention.

Referring to FIG. 9, the axes 53 of the spray apertures of the atomisers 45 are each offset to an angle $\omega=20°$ relative to the respective cylinder radius 73 drawn from the spray aperture. As for the embodiment shown in FIG. 8, all the apertures are offset to the same side of the cylinder axis 57, as viewed from each aperture. By increasing the radial offset ω to 20°, the outer concentration zone disappears, since the droplets intercept the cylinder wall before they can converge. An inner concentration zone occurs at $r_d=R\tan(35-20)=0.27R$. This arrangement gives good penetration of the droplets into the region near the centre of the cylinder and provides liquid to outer areas of the cylinder which are not well covered by the adjacent conical spray.

In other embodiments, the radial offset angle ω may be different for different atomisers. In such an arrangement, it is important to avoid convergent axes of neighbouring or nearby spray apertures to avoid large variations in concentration, for example in which more water is supplied to one annular segment than to another. In one preferred arrangement, a modest variation in radial offset angle is applied to the spray apertures, with the angular offset being applied in the same direction so that the spray aperture axes lie on the same side of the cylinder axis when viewed from a respective aperture. The variation in the radial offset may, for example be between about 10° and 20°, and an example of such an arrangement is shown in FIG. 10.

Referring to FIG. 10, the difference in radial offset angle between axes of adjacent spray apertures is 10° with the actual radial offset angle $\omega_1$ of the axes of some atomisers 46 being 10° and the radial offset $\omega_2$ of other adjacent atomisers 48 being 20°. This variation in angular offset is sufficient to smear out or disperse the annular concentration zones. Therefore, this arrangement provides less annular concentration and a more even distribution across the cylinder. To enhance the evenness of the distribution even further, the atomisers can be arranged so that spray apertures with axes whose radial offset angles are such that the axes tend to converge can be oriented at angles relative to the cylinder axis such that their axes are more divergent in this direction, and vice versa, in order to minimise the overall convergence of sprays from spray apertures which are close together.

Thus, it can be appreciated that applying a radial offset to the spray axes of the atomisers can significantly improve the distribution of droplets throughout the cylinder. A further advantage of applying a radial offset and in particular an offset to the same side of a respective radius, is that it encourages a rapid circulation of the gas in the cylinder which tends to smear out or disperse circumferential non-uniformities, particularly in the outer regions of the cylinder.

The atomisers may comprise discrete components and may be individually mounted around the circumference of the cylinder, in the cylinder wall and/or in the cylinder head and/or in the peripheral corner between the two. A number of atomisers may be arranged in one or more discrete units which may be integrally formed and may be supplied with liquid from a common supply conduit or channel. In one embodiment, the atomisers are arranged in a ring or collar with an internal channel formed around the ring for supplying liquid to each atomiser. An embodiment of such an arrangement is shown in FIG. 11 which, in particular shows a cross-section through the ring transverse to the ring axis.

Figure 11:
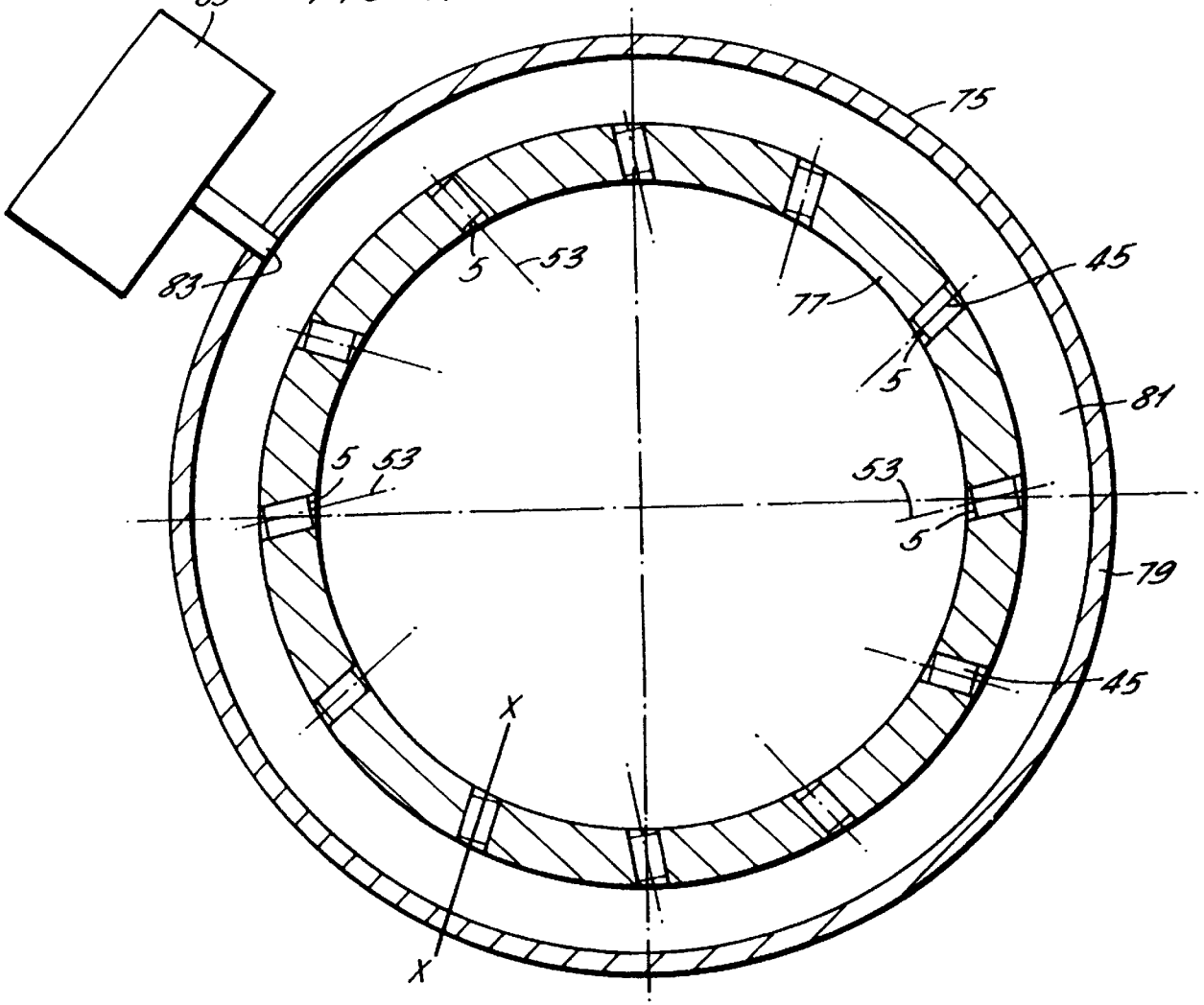
FIG. 11 shows a cross-sectional view of a compression cylinder and atomiser arrangement according to another embodiment of the present invention.

Referring to FIG. 11, the ring 75 comprises a discrete support 77 in which are mounted a plurality of atomisers 45. A liquid supply channel 81 is formed between the ring 75 and an outer wall 79, which may be formed by part of the cylinder casing, to supply each atomiser 45 with liquid. Liquid is fed into the supply channel 81 through an inlet port 83 formed in the outer casing 79 and a pump 85 for pumping liquid to the atomisers 45 is connected to and adjacent the outlet port 83. The swirl atomisers 45 may comprise entirely discrete components, separate from the ring, or at least part of the atomisers, e.g. their external body portions may be formed integrally with the ring 75. The use of discrete atomisers or at least atomiser components, particularly internal components may be more convenient and less expensive as they can be manufactured and supplied separately and would be individually replaceable. In accordance with the preferred embodiments, both axial and radial offsets are applied to the axes 53 of the spray apertures 5 of the atomisers 45 so that, collectively, the atomisers distribute liquid in substantially equal concentrations across the cylinder, and with the desired variation in concentration along the cylinder.

In another embodiment, the ring may be provided with a plurality of fluid inlet ports and these may be circumferentially spaced around the ring. The ring may comprise two or more discrete sections, e.g. segments, each having a separate liquid feed channel and one or more fluid inlets. The ring may be removed and replaced as a single unit or if it comprises a number of discrete units, each may be individually removed, for example for testing or replacement.

Figure 12:
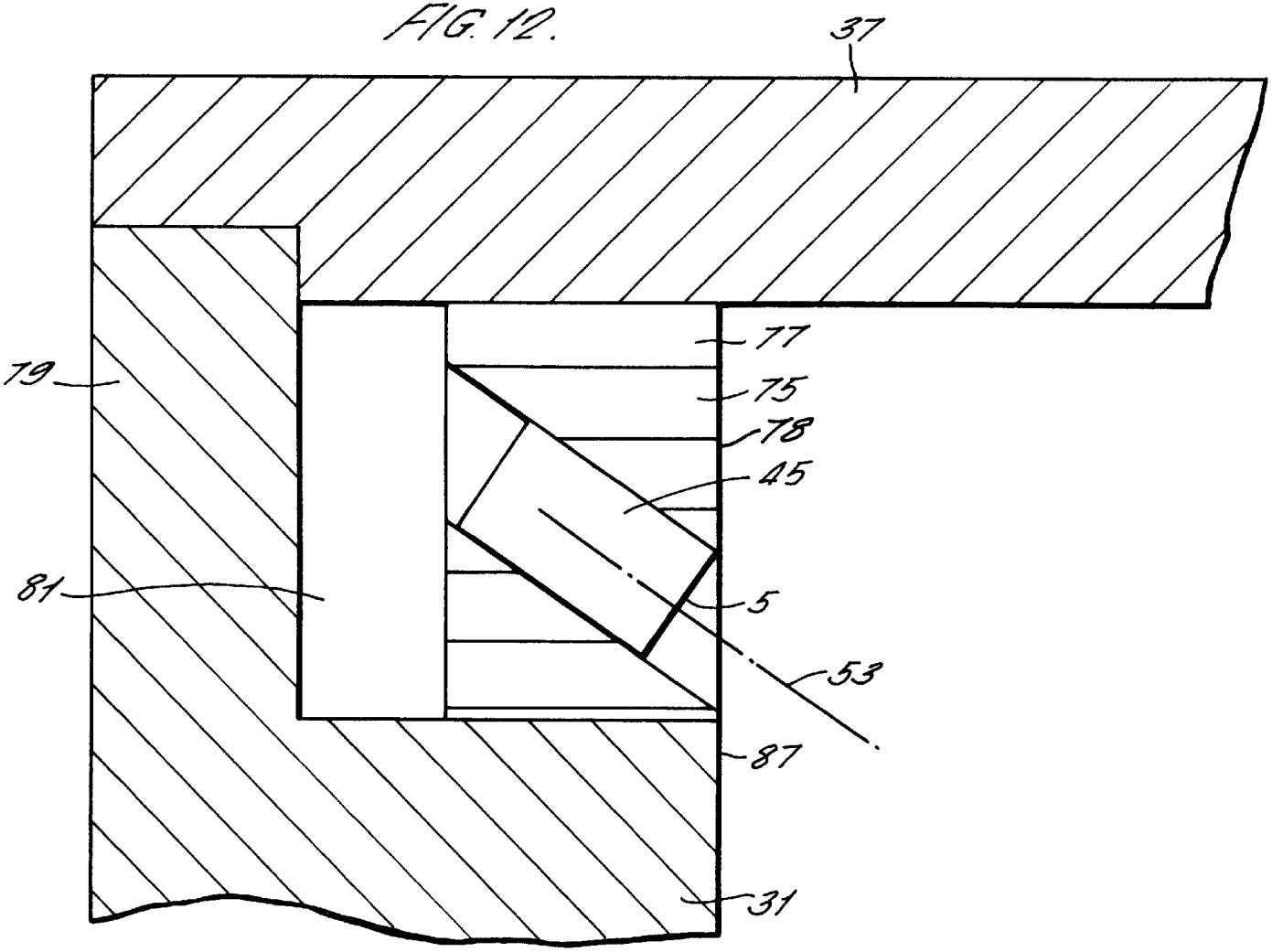
FIG. 12 shows a cross-sectional view through a member containing at least one atomiser according to an embodiment of the present invention.

FIG. 12 shows an embodiment of a cross-section of the ring 75 shown in FIG. 11 along the line X—X. In this embodiment, the face 78 of the ring 75 defines part of the inner surface 87 of the cylinder 31.

Figure 13:
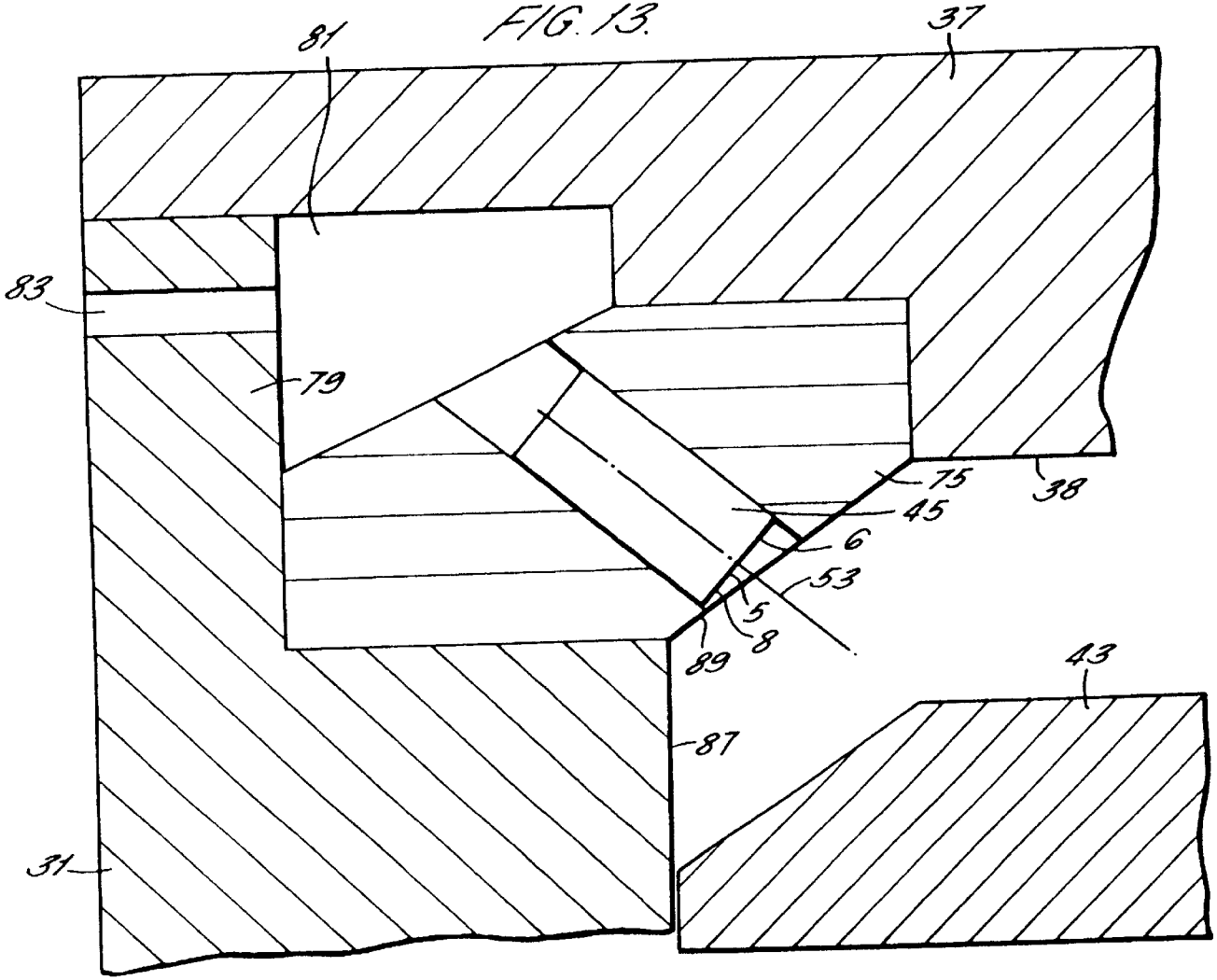
FIG. 13 shows a cross-sectional view through part of a compression cylinder according to another embodiment of the present invention.

FIG. 13 shows a cross-sectional view through part of the cylinder where the cylinder head 37 joins the cylinder wall 31, with a spray aperture located in the peripheral corner 89 between the cylinder head 37 and cylinder wall 31. In this embodiment, the corner comprises a face 89 which is angled between the surfaces of the cylinder wall 87 and the cylinder head 38. The angled corner face which, if the cylinder is circular, forms an inner frusto-conical surface may be defined by a discrete support ring 75, similar to that described above with reference to FIG. 11.

Locating the spray apertures in the peripheral corner 89 of the cylinder enables the apertures to be positioned so that the top 6 of the spray aperture 5 is near or substantially flush with the surface 38 of the cylinder head and the lower part 8 of the aperture 5 is near or substantially flush with the cylinder wall 87. Moreover, the angled corner face allows the face of the spray apertures to lie more nearly in the plane of the cylinder surface in which they are accommodated. Preferably, the parts defining the spray aperture are completely recessed behind the corner face and the head of the piston is preferably shaped to match the shape of the piston head, including the corner portion so that the piston is free to travel, if necessary, all the way to the top of the cylinder.

The corner-located atomisers may comprise discrete components, individually mounted around the cylinder. Alternatively, or in addition, they may be mounted in an annular ring, for example as shown in FIG. 11, which may be a discrete unitary component, as shown in FIG. 13 or may be formed in the cylinder wall or cylinder head.

Figure 14:
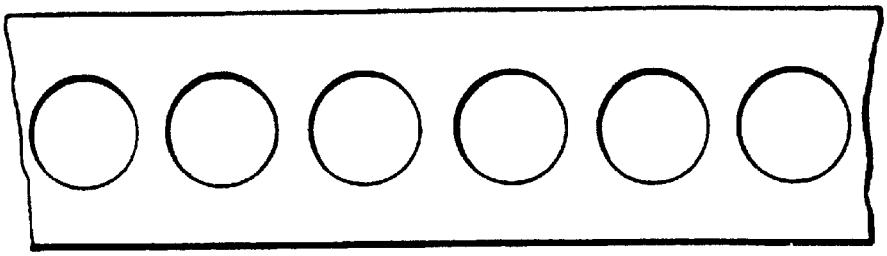
FIG. 14 shows an arrangement of atomisers according to an embodiment of the present invention.

The spray apertures may be arranged in a row, and within the row, the apertures may either be regularly spaced apart or arranged in clusters. There may either be a single row of atomisers or a plurality of rows of atomisers. FIG. 14 shows part of a single row of spray apertures, which may, for example be formed in part of an annular ring as shown in FIGS. 11 and 12.

Figure 15:
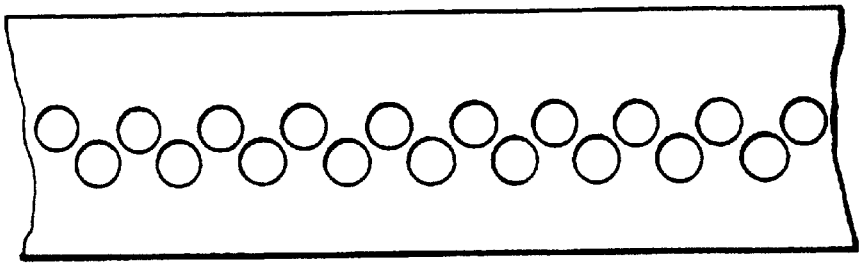
FIG. 15 shows an alternative arrangement of atomisers according to another embodiment of the invention.

FIG. 15 shows an alternative arrangement of two rows of spray apertures, in which each aperture is smaller than those shown in FIG. 14 and which are packed substantially within the same space. One advantage of a multiple small aperture arrangement compared to a single larger aperture arrangement is that the multiple smaller aperture arrangement can generate the same mass flow of droplets from the same area as the single aperture but with smaller droplets. Another advantage of the multiple smaller spray aperture arrangement is that adjacent apertures can be angled differently. In the case of a multiple row arrangement, the upper row can be angled so that the upper edge of the spray cone is aligned with the cylinder head and the lower row of spray apertures can be angled so that the lower edge of the spray cone is aligned with the cylinder wall. In another embodiment, the spray apertures may be grouped together in clusters and each cluster may be formed within a plug which may be inserted into the wall or head of the cylinder. Each cluster or plug may have a common liquid supply feed and the plug body may provide a common outer body for each of the individual atomisers. Conveniently, each cluster may be removed individually to allow ease of inspection and replacement. Any number of atomisers may be grouped together in a cluster, but preferably the spray apertures are arranged so that as many apertures as possible can be accommodated within a plug of a given size or area in which the spray apertures can be formed.

Figure 16:
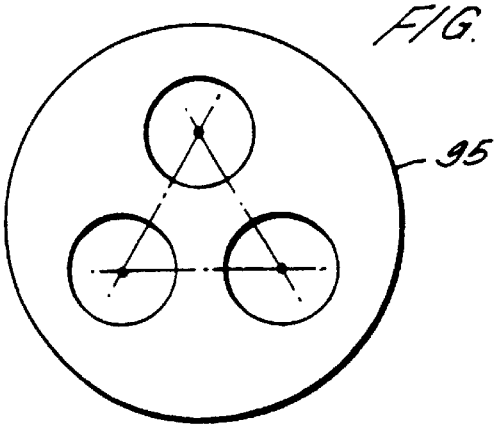
FIG. 16 shows the front view of an embodiment of a plug arrangement containing a plurality of atomisers.
Figure 17:
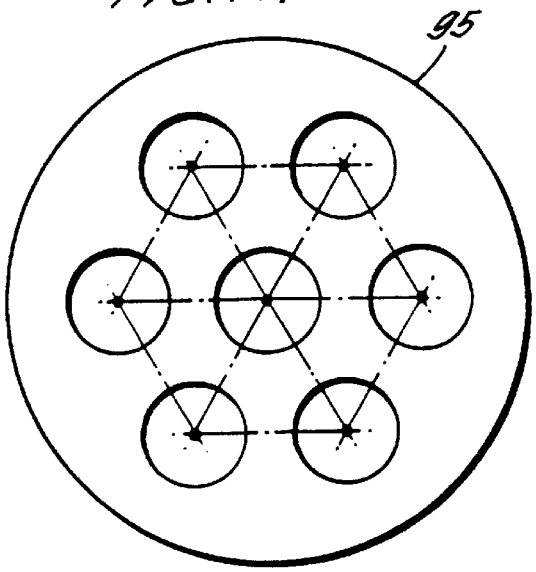
FIG. 17 shows the front view of another embodiment of a plug arrangement containing a plurality of atomisers.
Figure 18:
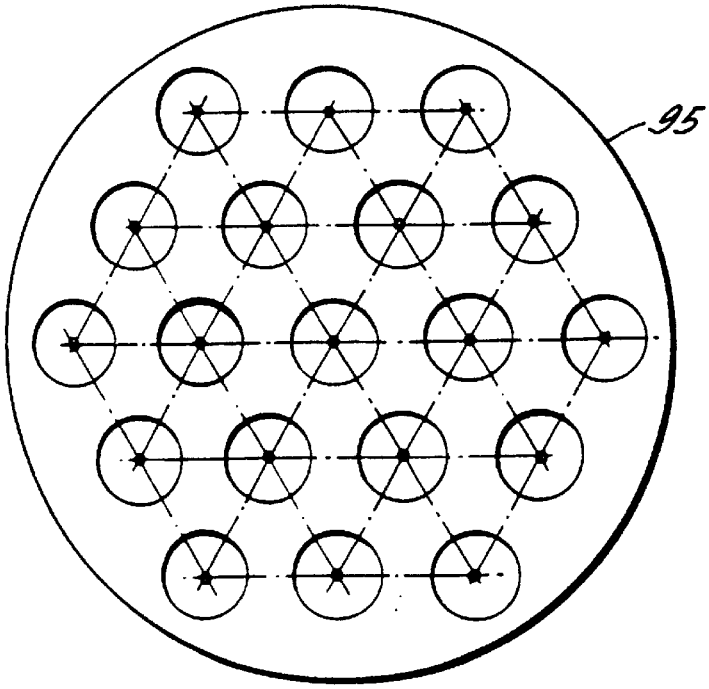
FIG. 18 shows a front view of another embodiment of a plug arrangement containing a plurality of atomisers.

FIGS. 16 to 18 each show one possible cluster arrangement within a cylindrical plug 95. The spray apertures are arranged using a triangular pitch to achieve compact grouping so that a large number of atomisers can be accommodated within each plug 95. In the examples, the cluster shown in FIG. 16 contains three spray apertures, the cluster shown in FIG. 17 has seven spray apertures and the cluster shown in FIG. 18 comprises nineteen apertures.

In a preferred embodiment, the flow of liquid into the cylinder is controlled so that liquid is sprayed into the cylinder only during compression, and preferably the flow rate of liquid into the cylinder is varied during compression, with the flow rate increasing with increasing gas pressure. In this way, liquid is only injected into the compression cylinder during that part of the cycle in which it is required and only in quantities over that part of the cycle which are specifically necessary to provide sufficient cooling of the gas. Such control both minimises the amount of liquid used per cycle and the energy consumed in cooling the gas. One particularly important advantage of the present spray apparatus is its ability to form and switch off the spray very quickly. Furthermore, the liquid flow from the spray apertures changes rapidly with changes in the pressure of liquid fed to the atomiser. In other words, the atomiser is very responsive to changes in flow pressure. Furthermore, the inventors have found that there is a surprising improvement in the spray distribution between adjacent conical sprays as the duration of the pulse decreases. This is particularly advantageous as it means that the heat absorption characteristics of the spray improves as the spray duration decreases permitting the compression rate to be increased with a smaller increase in gas temperature than would otherwise be the case. Therefore, there is a particular synergy between the use of an arrangement of multiple pressure swirl atomisers with interfering sprays and pulsed activation of the sprays.

Figure 19:
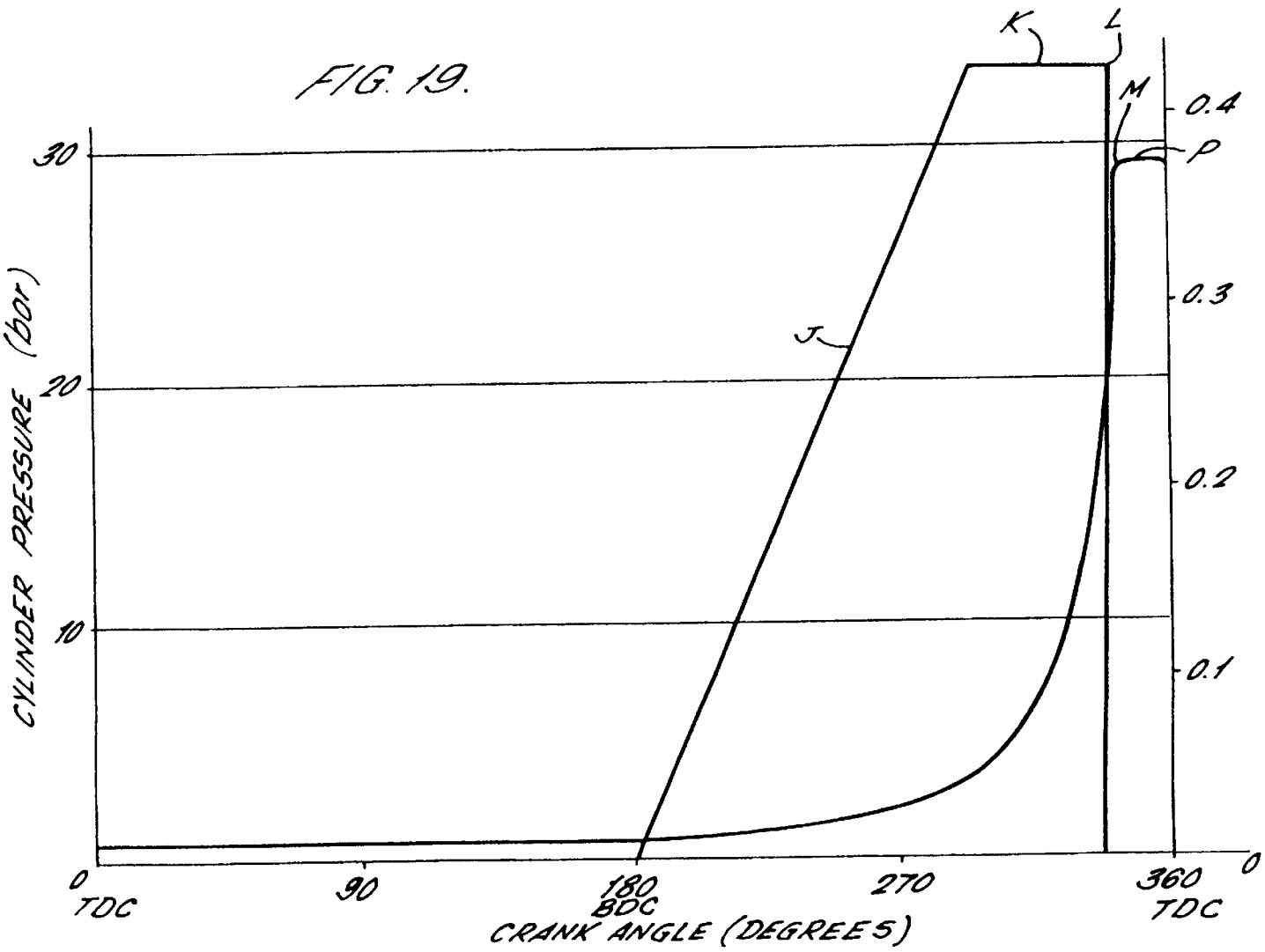
FIG. 19 shows a graph illustrating the variations in cylinder gas pressure and liquid flow rate into the compression cylinder with crankshaft angle.

FIG. 19 shows an example of how the flow rate is varied over a compression cycle and is compared with the variation in cylinder pressure. Between 0° and 180° of the crank angle, the piston travels from the top of the cylinder at top dead centre, to the bottom of its stroke, at bottom dead centre, and draws gas into the cylinder until the gas inlet valve closes near the bottom of the stroke. As the piston moves into the compression cylinder it starts to compress the gas and the atomisers are activated. Initially, the spray flow is relatively low and is preferably limited to that which is required to absorb the relatively low heat energy released during the early stages of compression. As the compression continues, the energy release increases and the spray flow is increased to increase the absorption capacity of liquid within the cylinder. At a predetermined point during compression, the spray flow is increased to a predetermined level K and is maintained at around that level for at least part of the latter part of compression. As there is a finite period between the time at which droplets enter the cylinder and the time at which the transfer of heat from the gas into the droplets is complete, i.e. when the temperature of the droplets reaches the ambient gas temperature, the flow rate is generally controlled so that droplets are sprayed within the cylinder slightly before their additional absorption capacity is required. Therefore, at a predetermined point L just prior to the end of compression M the sprays are shut off and the flow rate rapidly falls to zero. The piston continues to compress the gas to the end of compression, the additional heat of compression being absorbed by the most recently introduced droplets. At the end of the compression stroke, the gas outlet valve opens and the piston continues its upward travel to push the gas and spray liquid out of the cylinder through one or more gas outlet ports. During this time, the gas pressure remains substantially constant, as indicated by the flat portion P of the cylinder pressure curve.

It is important that the controller for controlling the flow rate to the spray nozzles has the ability to control the flow rate very precisely. In particular, the controller, an example of which is shown in FIG. 18, should preferably be able to provide a pulsed flow rate with predetermined variations of flow rate within the pulse. In a preferred embodiment, the controller comprises a hydraulically actuated pump, in which the movement of the pump piston follows a preset pattern. In another embodiment, the controller comprises a mechanically actuated pump in which movement of the pump piston is controlled by a cam which causes the piston to move according to a prescribed pattern. In other embodiments, the pump may be actuated pneumatically (e.g. with air or other gas) or by electromagnetic means, although it might be harder to control the movement of the piston pump and to provide the high injection pressures that are needed towards the end of each injection pulse.

Preferably, the pump is situated close to the atomisers to minimise any time delay between operation of the pump and the injection of liquid, which would otherwise be caused by long pipelines. For the same reason, it is also important that no air or gas leaks into the pipe work between the pump and atomisers, as the formation of gas pockets will again cause significant time delays. Positioning the pump as close to the atomisers as possible also assists in minimising the possibility of air leakage. Although it is desirable from the point of view of simplicity to drive the atomisers with only one pump, a plurality of pumps may be arranged to drive individual groups of one or more atomisers. This will allow different pumps to be controlled in different ways so as to provide different flow rate profiles and/or different flow rate timings for different atomisers. For example, spray injection could begin early for one group of atomisers which give a fairly even spread of droplets along the cylinder and could begin later for another group of atomisers which are intended to give more flow to the top part of the cylinder. There may be considerable flexibility in the timing of injection for the various atomisers. In one embodiment, there may be a plurality of rows of atomisers displaced along the cylinder axis and in which a lower row is at least partially blocked by the piston during compression. In this case, it might be beneficial to shut off the supply to the lower row before shutting off the supply to the upper row at the end of compression.

In another embodiment, the sprays from the atomisers in a lower row may be shut off by the piston. If adjacent rows are fed by a common supply, closing off the lower spray apertures could be used to automatically increase the flow rate through the upper row spray apertures during the latter part of the compression stroke.

In another embodiment, the largest collective flow capacity may be provided by those atomisers whose sprays are directed into the gas space near the end of the cylinder adjacent the cylinder head. This helps to ensure that the increasing demand for liquid during the latter part of compression as the gas space within the cylinder diminishes, can be met.

In another embodiment, one or more atomisers may be arranged to generate a spray having a larger or smaller cone angle than one or more other atomisers, depending for example on their relative position and orientation. Such an arrangement may be used to improve the distribution of droplets in the gas at various points in the cycle.

In any of the embodiments described above, as well as other embodiments, one or more of the atomisers may additionally have means for forming a spray in their respective hollow conical sprays. Such an additional spray may be formed from a separate orifice substantially coaxial with the axis of the conical spray aperture and formed in the atomiser. Any embodiment may additionally have other types of atomisers for spraying liquid into the cylinder which do not operate on the pressure swirl principle. For example, atomisers or other spray injectors which produce a flat spray may be arranged to spray liquid across the space near the end of the cylinder. Advantageously, the use of flat sprays directed substantially parallel to the cylinder and piston head surfaces, can provide an efficient means of injecting heat transfer liquid into the shallow gas space as the piston approaches the cylinder head, and, may be only activated in that part of the cycle, or in other parts of the cycle as well.

References herein to circumferentially spaced apertures mean spaced generally around an axis without any limitation on the distance from the axis. In particular, the distance is not limited to the radius of the cylinder. For example, circumferentially spaced spray apertures may be arranged between the centre of the cylinder and cylinder wall, e.g. in the cylinder head.

The spray liquid may be supplied from any suitable source and at any desired temperature, and may be recirculated through a heat exchanger and/or cooler.

The cylinder may have any cross-sectional geometry, e.g. circular, square, rectangular, elliptical, oval, any polygonal geometry, irregular, as well as other geometries.

Although embodiments of the invention have been described with reference to gas compressors, the spray apparatus described herein can also be used as a means of injecting liquid into a cylinder to provide a heat source for expanding gas, for example in an isothermal expansion process. Apparatus for generating power which are driven by the injection of hot liquid into an expansion cylinder are described in the Applicant's Patent Nos. GB-A-2283543, GB-A-2300673 and GB-A-2287992, the content of which are incorporated herein by reference.

Further modifications to the embodiments described herein will be apparent to those skilled in the art.

What is claimed is:

1. An apparatus comprising a chamber for containing gas, a piston for changing the volume of the gas in said chamber, a plurality of atomisers, each comprising an aperture for admitting liquid therethrough into said chamber, means for delivering a flow of liquid to said apertures, each atomiser further comprising means defining a flow path for imparting rotary motion to said flow of liquid about the axis of said aperture so that on leaving said aperture the liquid divides into a spray in said chamber, and wherein said aperture is positioned adjacent another said aperture and the axes of said adjacent apertures are oriented such that their respective sprays intersect at a position proximate at least one of said adjacent apertures.

2. An apparatus as claimed in claim 1, wherein the axes of said adjacent apertures are oriented such that their respective sprays intersect at a distance from at least one said adjacent aperture of less than the minimum distance between said adjacent apertures.

3. An apparatus as claimed in claim 1, wherein said chamber comprises a cylinder.

4. An apparatus as claimed in claim 3, wherein the angle between the axis of at least one of said apertures and a line parallel to the axis of said cylinder is different from the angle between the axis of at least one other said aperture and a line parallel to the axis of said cylinder.

5. An apparatus as claimed in claim 4, wherein said one aperture is adjacent said one other aperture.

6. An apparatus as claimed in claim 3, wherein the axis of at least one of said apertures is oriented such that the flow of part of said spray nearest the end of said cylinder approached by a piston at top dead center is substantially aligned with said end.

7. An apparatus as claimed in claim 3, wherein the axis of at least one of said apertures is oriented such that the flow of part of said spray nearest the wall of said cylinder is substantially aligned with said wall.

8. An apparatus as claimed in claim 3, wherein a plurality of said apertures are circumferentially spaced around the axis of said cylinder and the angle between the axis of at least one of said apertures and a line parallel to the axis of said cylinder is different from the angle between the axis of an adjacent, circumferentially spaced aperture and a line parallel to the axis of said cylinder.

9. An apparatus as claimed in claim 8, wherein the difference in the angles of the axes of at least one pair of adjacent apertures relative to a line parallel to said cylinder axis is greater than the difference in the angles of the axes of one of said adjacent apertures and the next aperture circumferentially spaced from the other said adjacent aperture relative to a line parallel to said cylinder axis.

10. An apparatus as claimed in claim 3, wherein a plurality of said apertures are positioned around the wall of said cylinder adjacent to the end thereof.

11. An apparatus as claimed in claim 3, wherein the axis of at least one of said apertures is directed so as not to intercept said cylinder axis.

12. An apparatus as claimed in claim 11, wherein a plurality of said apertures including said at least one aperture are circumferentially spaced around the axis of said cylinder and the axis of said at least one circumferentially spaced aperture is offset at an angle relative to a line intersecting said aperture and the axis of said cylinder.

13. An apparatus as claimed in claim 12, wherein the axes of at least two or more said circumferentially spaced apertures are offset to the same side of a line intersecting a respective said aperture and the axis of said cylinder.

14. An apparatus as claimed in claim 13, wherein the axes of at least two or more adjacent circumferentially spaced apertures are offset to the same side of a line intersecting a respective said aperture and the axis of said cylinder.

15. An apparatus as claimed in claim 13, wherein the axis of at least one of said apertures which is offset to the same side is offset at an angle relative to a respective said line which is different to the angle at which the axis of at least one other of said apertures which is offset to the same side is offset relative to a respective said line.

16. An apparatus as claimed in claim 3 arranged such that the spread angle of the conical spray from at least one of said apertures is different from the spread angle of other apertures.

17. An apparatus as claimed in claim 3, wherein at least two or more of said apertures are spaced apart in a direction parallel to the axis of said cylinder.

18. An apparatus as claimed in claim 17, wherein a plurality of said apertures are circumferentially spaced around the cylinder wall with a plurality of said circumferentially spaced apertures being spaced apart in a direction parallel to the axis of said cylinder.

19. An apparatus as claimed in claim 18, wherein at least two adjacent apertures are spaced apart in a direction parallel to the axis of said cylinder.

20. An apparatus as claimed in claim 1, wherein said means for delivering includes a conduit and a plurality of said atomisers are connected to receive liquid from said conduit.

21. An apparatus as claimed in claim 3, wherein said cylinder comprises a plurality of discrete parts, at least one of which contains a plurality of said apertures and respective said means defining a flow path for said apertures.

22. An apparatus as claimed in claim 21, wherein said at least one part further includes a conduit and a plurality of said means defining are connected to said conduit.

23. An apparatus as claimed in claim 21, wherein said at least one part comprises a removably mounted transverse section of said cylinder.

24. An apparatus as claimed in claim 21, wherein said at least one part comprises a removably mounted plug.

25. An apparatus as claimed in claim 24, wherein the periphery of the face of said plug containing said apertures is substantially circular.

26. An apparatus as claimed in claim 3, comprising a gas compressor and including control means arranged to control the flow rate of liquid through a plurality of said apertures such that, during the initial part of compression, the flow rate increases with the increasing pressure of gas in said compression cylinder, and is maintained at or above a predetermined rate in the latter part of compression and is stopped before the pressure of gas in said cylinder reaches a maximum value.

27. An apparatus as claimed in claim 26, wherein said control means is arranged to deliver liquid at a first flow rate through apertures whose sprays are directed into the volume adjacent the end of said cylinder and a second flow rate through apertures whose sprays are directed away from said volume, wherein the first flow rate is higher than the second flow rate.

28. An apparatus as claimed in claim 1 comprising a gas compressor.

29. An apparatus as claimed in claim 28 including control means arranged to control the flow of liquid through a plurality of said apertures such that liquid is sprayed through said apertures during compression and is stopped before the pressure of gas in said chamber reaches a maximum value.

30. An apparatus as claimed in claim 1 including means for cooling the liquid before being sprayed into said chamber.

31. An apparatus as claimed in claim 1 comprising a gas expander and comprising means for delivering pressurised gas into said chamber, and control means for spraying liquid into said chamber during expansion of gas therein.

32. An apparatus comprising a cylinder for containing gas, a piston for changing the volume of the gas in said cylinder, a plurality of atomisers, each comprising an aperture for admitting liquid therethrough into said cylinder, means for delivering a flow of liquid to said apertures, each atomiser further comprising means defining a flow path for imparting rotary motion to said flow of liquid about the axis of said aperture so that on leaving said aperture the liquid divides into a spray in said cylinder, and wherein the angle between the axis of at least one of said apertures and a line parallel to the axis of said cylinder is different from the angle between the axis of at least one other said aperture and a line parallel to the axis of said cylinder.

33. An apparatus as claimed in claim 32, wherein said one aperture is adjacent said one other aperture.

34. An apparatus as claimed in claim 32, wherein a plurality of said apertures are circumferentially spaced around the axis of said cylinder and the angle between the axis of at least one of said apertures and a line parallel to the axis of said cylinder is different from the angle between the axis of an adjacent, circumferentially spaced aperture and a line parallel to the axis of said cylinder.

35. An apparatus as claimed in claim 34, wherein the difference in the angles of the axes of at least one pair of adjacent apertures relative to a line parallel to said cylinder axis is greater than the difference in the angles of the axes of one of said adjacent apertures and the next aperture circumferentially spaced from the other said adjacent aperture relative to a line parallel to said cylinder axis.

36. An apparatus as claimed in claim 32, wherein the axis of at least one of said apertures is oriented such that the flow of part of said spray nearest the end of said cylinder is substantially aligned with said end.

37. An apparatus as claimed in claim 32, wherein the axis of at least one of said apertures is oriented such that the flow of part of said spray nearest the wall of said cylinder is substantially aligned with said wall.

38. An apparatus as claimed in claim 32, wherein a plurality of said apertures are positioned around the wall of said cylinder adjacent to the end thereof.

39. An apparatus as claimed in claim 32, wherein the axis of at least one of said apertures is directed so as not to intercept said cylinder axis.

40. An apparatus as claimed in claim 39, wherein a plurality of said apertures including said at least one aperture are circumferentially spaced around the axis of said cylinder and the axis of said at least one circumferentially spaced aperture is offset at an angle relative to a line intersecting said aperture and the axis of said cylinder.

41. An apparatus as claimed in claim 40, wherein the axes of at least two or more said circumferentially spaced apertures are offset to the same side of a line intersecting a respective said aperture and the axis of said cylinder.

42. An apparatus as claimed in claim 41, wherein the axes of at least two or more adjacent circumferentially spaced apertures are offset to the same side of a line intersecting a respective said aperture and the axis of said cylinder.

43. An apparatus as claimed in claim 41, wherein the axis of at least one of said apertures which is offset to the same side is offset at an angle relative to a respective said line which is different to the angle at which the axis of at least one other of said apertures which is offset to the same side is offset relative to a respective said line.

44. An apparatus comprising a cylinder for containing gas, a piston for changing the volume of the gas in said cylinder, a plurality of atomisers, each comprising an aperture for admitting liquid therethrough into said cylinder, means for delivering a flow of liquid to said apertures, each atomiser further comprising means defining a flow path for imparting rotary motion to said flow of liquid about the axis of said aperture so that on leaving said aperture the liquid divides into a spray in said cylinder, and wherein the axis of at least one of said apertures is directed so as not to intercept the cylinder axis.

45. An apparatus as claimed in claim 44, wherein a plurality of said apertures including said at least one aperture are circumferentially spaced around the axis of said cylinder and the axis of said at least one circumferentially spaced aperture is offset at an angle relative to a line intersecting said aperture and the axis of said cylinder.

46. An apparatus as claimed in claim 45, wherein the axes of at least two or more said circumferentially spaced apertures are offset to the same side of a line intersecting a respective said aperture and the axis of said cylinder.

47. An apparatus as claimed in claim 46, wherein the axes of at least two or more adjacent circumferentially spaced apertures are offset to the same side of a line intersecting a respective said aperture and the axis of said cylinder.

48. An apparatus as claimed in claim 46, wherein the axis of at least one of said apertures which is offset to the same side is offset at an angle relative to a respective said line which is different to the angle at which the axis of at least one other of said apertures which is offset to the same side is offset relative to a respective said line.

49. A spray apparatus comprising a body adapted for connection to the cylinder housing of a reciprocating gas compressor, a plurality of atomisers mounted in said body and arranged circumferentially around the axis of said cylinder when in use, each said atomiser having an aperture arranged, in use, to spray liquid into said cylinder and further comprising means defining a flow path for imparting rotary motion to said flow of liquid about the axis of said aperture so that on leaving said aperture the liquid divides into a spray in said cylinder, and wherein a said aperture is positioned adjacent another said aperture and the axes of said adjacent apertures are oriented such that their respective sprays intersect at a position proximate at least one of said adjacent apertures.

50. A spray apparatus comprising a body adapted for connection to the cylinder housing of a reciprocating gas compressor, a plurality of atomisers mounted in said body and arranged circumferentially around the axis of said cylinder when in use, each said atomiser having an aperture arranged, in use, to spray liquid into said cylinder and further comprising means defining a flow path for imparting rotary motion to said flow of liquid about the axis of said aperture so that on leaving said aperture the liquid divides into a spray in said cylinder, and wherein the angle between the axis of at least one of said apertures and a line parallel to the axis of said cylinder is different from the angle between the axis of at least one other said aperture and a line parallel to the axis of said cylinder.

51. A spray apparatus as claimed in claim 50, wherein said one aperture is adjacent said one other aperture.

52. A spray apparatus comprising a body adapted for connection to the cylinder housing of a reciprocating gas compressor, a plurality of atomisers mounted in said body and arranged circumferentially around the axis of said cylinder when in use, each said atomiser having an aperture arranged, in use, to spray liquid into said cylinder and further comprising means defining a flow path for imparting rotary motion to said flow of liquid about the axis of said aperture so that on leaving said aperture the liquid divides into a spray in said cylinder, and wherein the axis of at least one circumferentially spaced aperture is offset at an angle relative to a line intersecting said aperture and the axis of said cylinder.

53. A spray apparatus as claimed in claim 52, wherein the axes of at least two or more said circumferentially spaced apertures are offset to the same side of a line intersecting a respective said aperture and the axis of said cylinder.

54. An apparatus as claimed in claim 53, wherein the axes of at least two or more adjacent circumferentially spaced apertures offset to the same side of a line intersecting respective said aperture in the axis of said cylinder.

55. A spray apparatus as claimed in claim 53, wherein the axis of at least one of said apertures which is offset to the same side is offset at an angle relative to a respective said line which is different to the angle at which the axis of at least one other of said apertures which is offset to the same side is offset relative to a respective said line.

56. A spray apparatus as claimed in claim 49 including a conduit arranged to supply liquid to at least two or more said circumferentially spaced apertures.

* * * * *